United States Patent [19]

Salomon

[11] 4,265,034

[45] May 5, 1981

[54] SKI BOOT

[75] Inventor: Georges P. J. Salomon, Annecy, France

[73] Assignee: S.A. Etablissements Francois Salomon & Fils, Annecy, France

[21] Appl. No.: 48,467

[22] Filed: Jun. 14, 1979

[30] Foreign Application Priority Data

Jun. 16, 1978 [FR] France ..... 78 18122
Apr. 27, 1979 [FR] France ..... 79 10811

[51] Int. Cl.[3] ..... A43B 5/04; A43B 21/00

[52] U.S. Cl. ..... 36/121; 36/105

[58] Field of Search ..... 36/117, 118, 119, 120, 36/121, 105

[56] References Cited

U.S. PATENT DOCUMENTS

| | | | |
|---|---|---|---|
| 3,543,420 | 12/1970 | Ader | 36/121 |
| 4,095,356 | 6/1978 | Robran et al. | 36/121 |
| 4,133,119 | 1/1979 | Kubelka | 36/121 |
| 4,138,828 | 2/1979 | Kubelka | 36/121 |

*Primary Examiner*—Patrick D. Lawson

*Attorney, Agent, or Firm*—Haseltine and Lake

[57] ABSTRACT

A ski boot comprises a continuous shell surrounding the foot (bottom of the shell) and the front of the bottom of the leg (upper) and respectively having zones of different rigidity and a rear cover or spoiler pivoted on said shell approximately in the malleolar zone surrounding the rear of said bottom of the leg and serving as cover for closing the boot on the foot, as well as means for rearwardly supporting the leg when in position of use. Means are provided for connecting said rear cover or spoiler and the monobloc upper bottom of shell assembly.

A member is also provided for supporting the upper formed by the rear cover and the upper, said member being able to occupy a first active position for limiting the rearward angular movement of said upper, and a second inactive position allowing this upper freedom of angular movement.

In active position of use, the support member removably mounted on the rear closing cover is in direct contact with the rigid bottom of the shell.

19 Claims, 12 Drawing Figures

9
16
17
9"
6"
20
15
14
12
13
11
10
6'
6
19
6'''
10a
18
9'
f
2'
2

16
17
9"
9
19
14
15
9'

FIG. 4
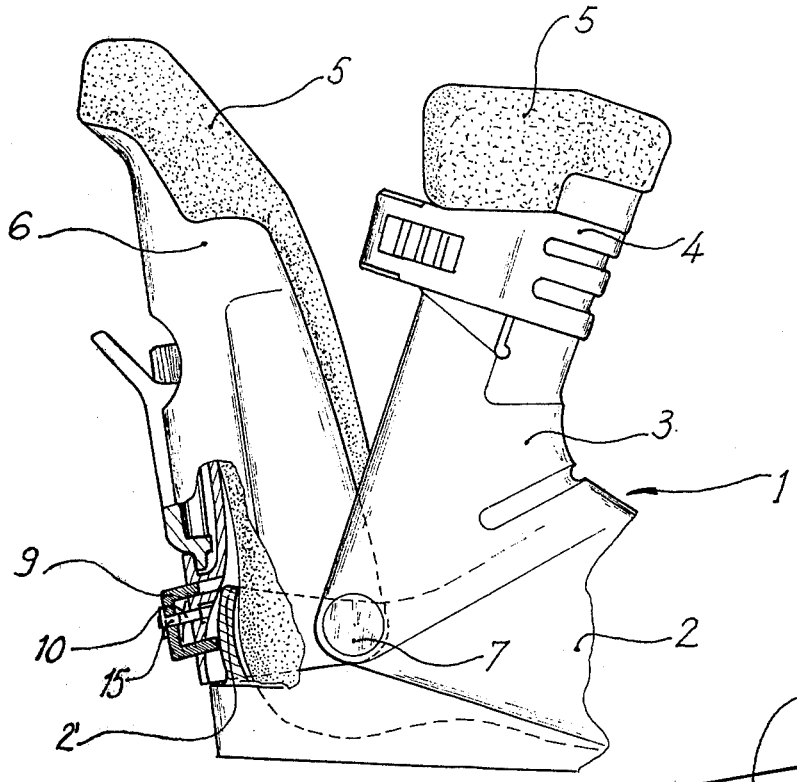
FIG. 5
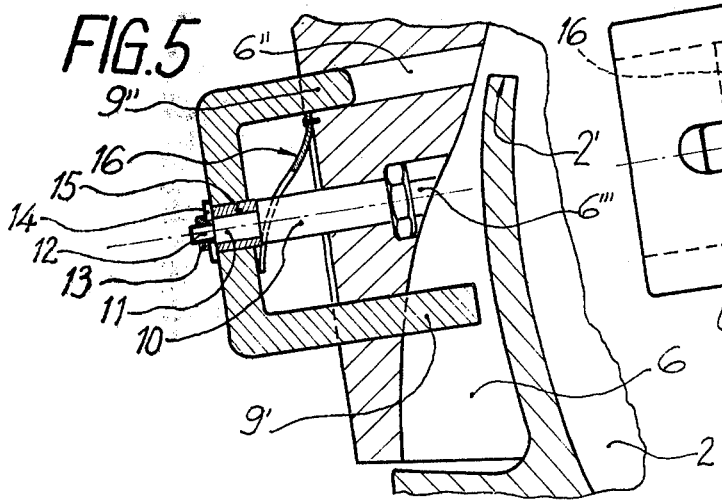
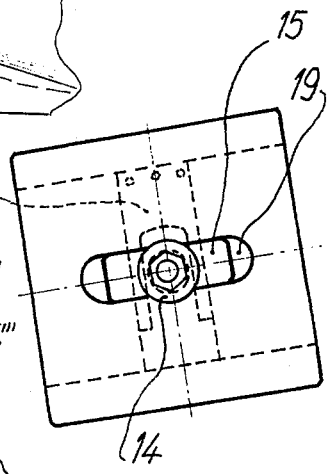
FIG. 6

SKI BOOT

BACKGROUND OF THE INVENTION

The present invention relates to a ski boot which is put on and taken off by the foot entering and leaving through the rear, and of which the position of the top part of the upper with respect to the bottom part of the boot, particularly during the movements of rear support whilst practising skiing, is determined by cooperating means provided between different elements composing the top part of the upper and the bottom part of the boot.

To this end, these boots are generally designed so that they are composed of at least two elements pivoted on each other. The first of these elements which forms a rigid bottom part of the shell, is intended to cover and surround the front part of the foot and the first element extends for example from the zone of the top of the foot to the tibial zone of the bottom of the leg, as a flexible upper. This first element is in one piece, but its rigidity varies according to the zones. The second element, or rear cover, also called "spoiler", is pivoted on the first element so as to pivot from an open position to a closed position. This second element covers the heel at the rear of the boot and extends upwardly to surround the back of the bottom of the leg. Moreover, its rigidity is greater in the tibial zone covering the bottom of the leg. When it is in open position, this second upper element is separated from the first element so that the angle of opening is sufficiently large to allow the skier's foot to enter from the rear to the front.

During skiing, the said two elements are held in closed position by any suitable means, such as straps, bands with buckles and hooks or the like, so that the angle and the bottom of the leg are firmly surrounded by the spoiler-upper assembly.

Ski boots are already known in which the above-mentioned cooperating means are constituted by a buckle and a hook which maintain the bottom of the spoiler tight on the bottom of the shell, in the zone located just above the ankles. However, the tightening thus obtained may not be sufficient due to the forces required to close the hook-buckle assembly, due to the considerable rigidity of the spoiler. As this latter is virtually undeformable, there could be no increase in the frictions which prevent it from pivoting rearwardly upon the considerble forces due to the movements of rear support. These forces tend to deform the upper which undergoes a rearward extension, this increasing the rearward angular movement of the whole of the upper of which the spoiler is part. Consequently, the necessary rear supports are lacking for the skier.

Ski boots are also known, which are put on from the rear, in which the limitation of the rearward angular movement of the spoiler is ensured only by the connection made by the hook of the bottom of the leg between the spoiler and the upper. In this case too, the necssary rear supports may be lacking for the skier when skiing. In other known ski boots, the angular blocking of the upper of these boots is effected by adjustable means which may or may not be elastic. However, these devices are essentially intended for boots in which, to put them on, the upper pivots with respect to an axis located in the zone of the ankles having an opening on the front of the foot. These devices have the drawback of being complex and consequently expensive.

In particular U.S. Pat. No. 3,543,421 describes a ski boot constituted by a rigid lower part and an upper part pivoted on said lower part, a support member being mounted on said upper part, this support member being able to come into a first position in abutment on the lower part. In this type of construction, it is necessary to provide, on this lower part, supplementary support means ensuring the position in abutment of the upper part or "collar" of the upper which is totally pivoted on the lower part. Moreover, the supplementary support means increase the cost price of the boot not only due to the cost of the parts but also due to the costs of assembly on the bottom of the shell.

SUMMARY OF THE INVENTION

It is an object of the present invention to remedy these drawbacks by providing a ski boot such that the aptitude to put it on from the rear is ensured whilst making possible the necessary rear supports, when the boot is worn for skiing, which are partly lacking in the design of the elements composing said boot.

To this end, this ski boot of the type which is put on or taken off through the rear, comprising:

- a continuous shell surrounding the zones of the foot (bottom of the shell) and the front of the bottom of the leg (upper) and respectively having zones of different rigidity.
- a rear cover or spoiler pivoted on said shell approximately in the malleolar zone surrounding the rear of said bottom of the leg and serving as cover for closing the boot on the foot, as well as means for rearwardly supporting the leg when in position of use,
- connecting means connecting said rear cover or spoiler and the monobloc upper bottom of shell assembly,
- a member for supporting the upper formed by said rear cover and the upper, that may occupy a first active position for limiting the rearward angular movement of said upper, and a second inactive position allowing this upper freedom of angular movement, is characterised in that, in active position of use, the support member removably mounted on the rear closing cover is in direct contact with the rigid bottom of the shell.

According to a further feature of the invention, the support member is mounted to move rearwardly, and vice versa, in at least one slot formed in the lower part of the spoiler, the support member being mounted to slide or pivot.

According to another feature of the invention, the support member cooperates by its lower face, in active position, with an upper edge of the rear part of the bottom of the shell.

In inactive position, the support member may be held engaged through the spoiler or it may be separated therefrom.

According to a variant embodiment of the invention, the support member mounted to move on the spoiler is constituted by a lever of cross-section substantially in L form pivoting about a transverse axis, this lever comprising a large arm extending upwardly substantially parallel to the rear face of the spoiler and a small lower arm extending forwardly of the boot and abutting on the rear part of the bottom of the shell in active position offering rear support.

According to a further feature of the invention, the ski boot comprises elastic means which constantly urge the lever forming support member towards its active position offering rear support.

The ski boot according to this latter variant of the invention offers the advantage that the pivoting lever constituting the support member clips automatically into active position offering rear support as soon as the foot is placed in the boot. In addition, by simple pressure exerted by the skier on the lever forming support member, it is possible to eliminate locking in active position allowing the rearward release of the upper rear part or spoiler pivoted on the bottom of the shell. Consequently the opening of the upper of the boot then allows said boot to be easily put on or taken off.

BRIEF DESCRIPTION OF THE DRAWINGS

The invention will be more readily understood on reading the following description with reference to the accompanying drawings, in which:

FIG. 4 is a view in elevation, with partial vertical section, of the ski boot according to the invention, in open position, the support member then being in inactive position.

FIG. 5 is a view in longitudinal vertical section, on a larger scale, of the lower, rear part of the boot in open position, FIG. 6 is a partial side view seen from the left of FIG. 5.

DESCRIPTION OF THE PREFERRED EMBODIMENTS

Figure 1:
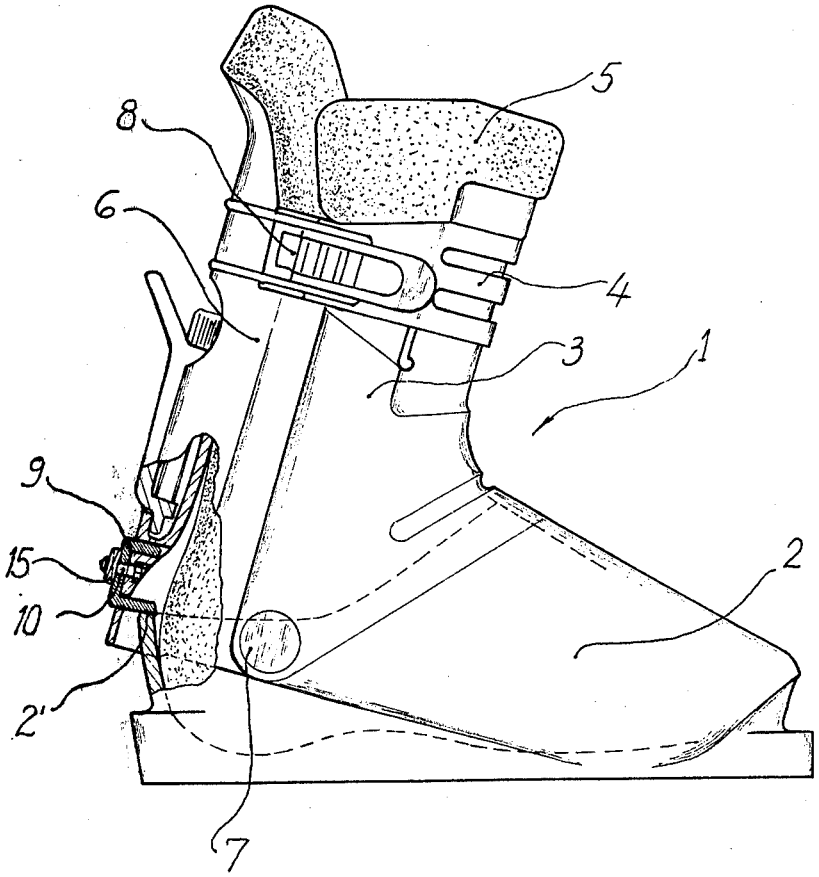
FIG. 1 is a view in elevation, with part section, of a ski boot according to the invention, in closed position, the support member then being in active position, limiting the angular movement of the upper of the boot toward the rear.

Referring now to the drawings, the ski boot shown in FIG. 1 comprises a first element or shell 1 which is composed of two parts, namely a rigid bottom part of the shell 2 and a more flexible upper part of the shell 3 to allow the forward flexions of a skier's leg, this flexible upper part 3 being fast with the bottom of the shell 2 via known assembly means. The first element 1 of the boot therefore envelops the whole of the front of the foot and the bottom of the skier's leg, whilst presenting the necessary qualities for skiing, such as the rigidity of the bottom part of the shell 2 which allows the close cooperation with a ski binding, and the flexibility in the front upper part 3 of the shell which allows the movements of forward flexion of the leg when skiing downhill.

The ski boot according to the invention further comprises a second element or "spoiler" 6 which is pivoted on the first element 1 about a lower transverse axis 7, for example located substantially at the skier's ankle.

An inner lining 5 is placed in the boot formed by the two elements 1 and 6, to ensure comfort between the skier's foot and the rigid shell.

A strap 4 surrounds the top of the upper of the boot, formed by the front of the upper part 3 of the shell and the spoiler 6, and this strap 4 ensures, due to a hook and buckle system 8, the tightening of the bottom of the skier'leg, as well as the closure of the boot.

The second pivoted element, or spoiler 6, surrounds the rear of the bottom of the skier's leg and supports another device for internally tightening the foot, which is known per se. During skiing, the spoiler 6 follows the different movements of the skier's leg due to the association of the strap 4 and the hook and buckle closure system 8. The articulation 7 thus enables the spoiler 6 to follow the front of the upper 3 forwardly, during the forward flexion movements which are controlled by this more flexible upper.

During the movements of rear support of the skier's leg, the spoiler 6 continues to follow the skier's leg for the same reasons as set forth hereinabove. In fact, the flexible upper 3 then deforms rearwardly by extension and consequently the spoiler 6 pivots rearwardly about axis 7, which pivoting is harmful to skiing, particularly for racing skiers.

To remedy these drawbacks, the ski boot according to the invention comprises a support member 9 which is interposed between the spoiler 6 which supports the rear support forces, and the bottom of the rigid shell 2 which is fixed to the ski via the binding.

In the embodiment of the invention shown in FIGS. 1 to 6, the support member 9 is constituted by a U-sectioned piece of which the two side arms 9', 9'', of different lengths due to construction needs, are engaged in respective oblong slots 6', 6'' which are horizontal and parallel to each other, these slots being made in the lower, rear part of the spoiler 6. The lower arm 9' of the support member, which is the longer, passes right through the lower slot 6' of the spoiler 6 and then comes into contact with an upper edge 2' of the bottom of the shell 2, this edge upwardly defining the rear part of said shell bottom.

Figures 2, 3:
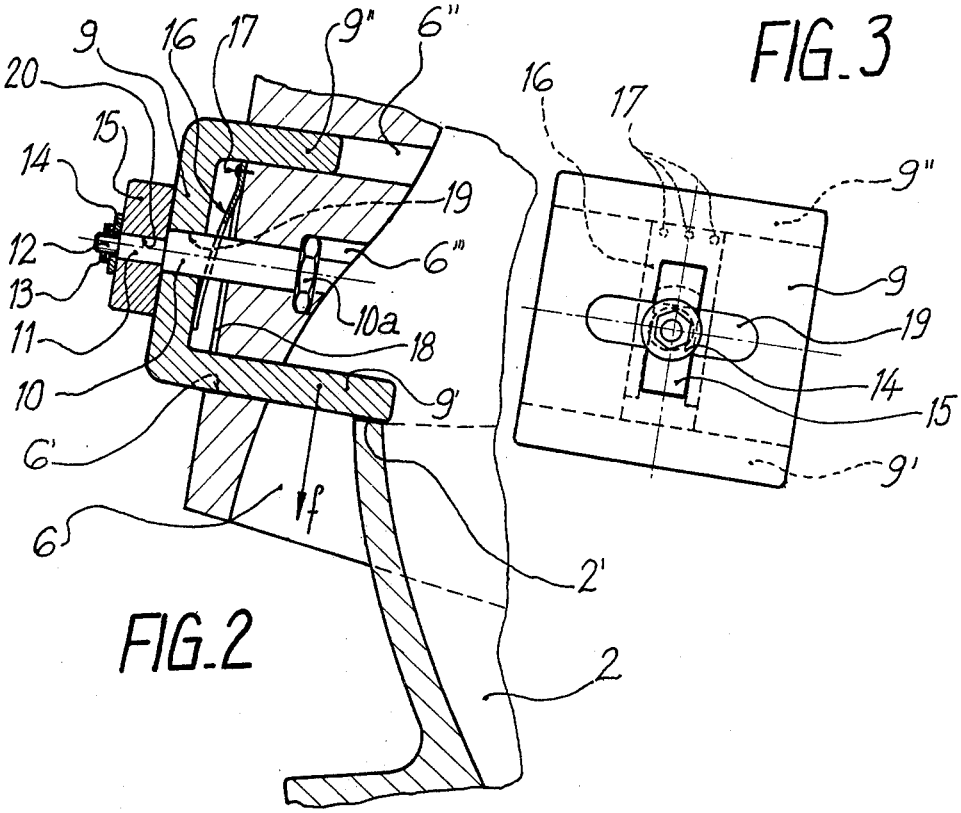
FIG. 2 is a view in vertical and longitudinal section, on a larger scale, of the lower, rear part of the boot in closed position, the support member being in active position.
FIG. 3 is a partial side view seen from the left of FIG. 2.

From the foregoing, it is seen that, in the case of rear support being exerted on the spoiler 6, the latter tends to pivot in anticlockwise direction about axis 7 and the support member 9 carried by the spoiler exerts on the edge 2' of the shell bottom 2, via its lower arm 9', a force indicated by arrow f in FIG. 2, which force is directed downwardly. The edge 2' of the shell bottom 2 thus constitutes a stop for the lower arm 9' of the support member 9 and a locking is thus obtained of the angular movement of the spoiler 6 towards the rear. This locking is obtained as the support member 9 is maintained in a maximum advanced position in the corresponding slots 6', 6''. The support member 9 is maintained in this active rear locking position by means of a device of the quarter turn type which comprises a lug 15 pivoted on a pin 10 fast with the lower rear part of the spoiler 6, this pin 10 extending rearwardly. This pin 10 passes through an oblong slot 19 extending horizontally and transversely in the web of the U-sectioned support member 9, the locking lug 15 being located outside with respect to this web. Furthermore, a spring 16, constituted by a curved leaf, fixed, at one of its ends 17, to the spoiler 6, constantly pushes the support member 9 and the locking lug 15 outwardly, against a stop constitued by a washer 14 maintained on a shouldered pin 11 extending the pin 10, by means of a nut 13 screwed on the threaded end 12 of this shouldered pin 11. The pin 10 presents at its inner end a head 10*a* embedded in a chamber 6''' provided in the lower, rear part of the inner face of the spoiler 6. This head ensures a good position of the pin 10 under all conditions of use.

FIGS. 2 and 3 show the device in locked position in which the locking lug 15 extends perpendicularly to the oblong slot 19 and consequently opposes any rearward shift of the support member 9, which is thus maintained in its extreme front position which is the active position of limitation of the rearward angular movement.

FIGS. 4, 5 and 6 show the boot in its open position in which the support member 9 is in inactive, unlocked position. In this case, to enable the spoiler 6 to be moved away from the front upper 3, by pivoting it rearwardly about axis 7, the support member 9 is passed into its inactive position by shifting it rearwardly from its advance position. To this end, the locking lug 15 is rotated by a quarter turn so as to be placed parallel to the oblong slot 19 of the support member 9, i.e. in horizontal position. The spring 16, which was previously compressed, then relaxes and pushes all the support member 9 rearwardly, this movement being made possible as the locking lug 15 may be retracted inside the oblong slot 19. The rearward movement thus authorised is sufficient for the whole of the lower arm 9' of the support member 9 to be shifted rearwardly beyond the upper edge 2' of the shell bottom 2 and thus to escape this edge, thus allowing the pivoting movement of the spoiler 6 in anti-clockwise direction about axis 7.

A variant embodiment will now be described, with reference more particularly to FIGS. 7 and 8. These figures show a ski boot of which the constituent elements which are identical to those of the boot illustrated in FIG. 1 are given the same reference numerals. In this variant embodiment, the ski boot is equipped with means enabling, simultaneously, foot to be tightened on the one hand and the rearward angular movement of the upper of the boot to be limited on the other hand, when there are rear supports.

Figure 7:
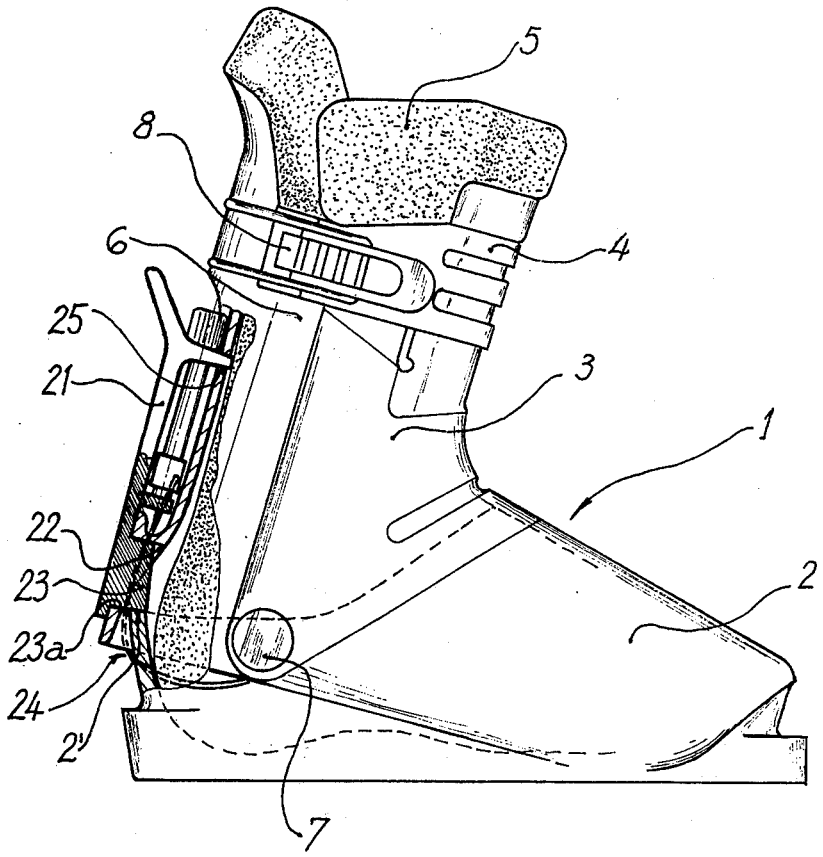
FIG. 7 is a view in elevation, with partial vertical section, of a variant embodiment of the ski boot according to the invention, in closed position.
Figure 8:
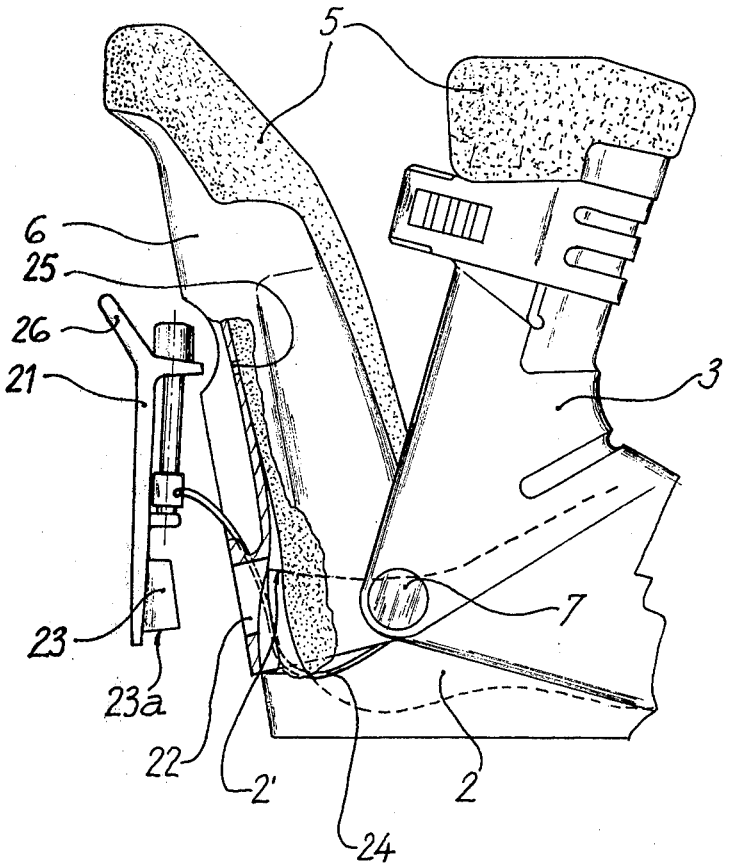
FIG. 8 is a view in elevation, with partial vertical and longitudinal section, of the boot of FIG. 7 shown in open position.
Figure 9:
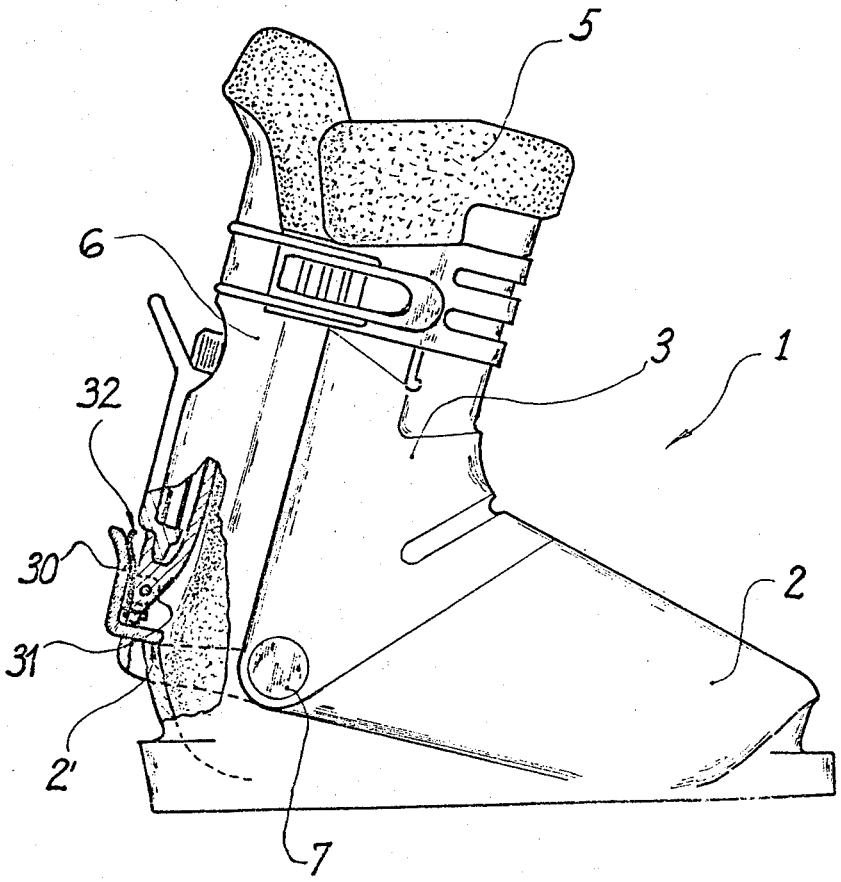
FIG. 9 is a view in elevation of another variant embodiment of a ski boot according to the invention, with a partial vertical section of its lower, rear part, in closed position, a lever forming support member being in active position offering rear support.
Figure 10:
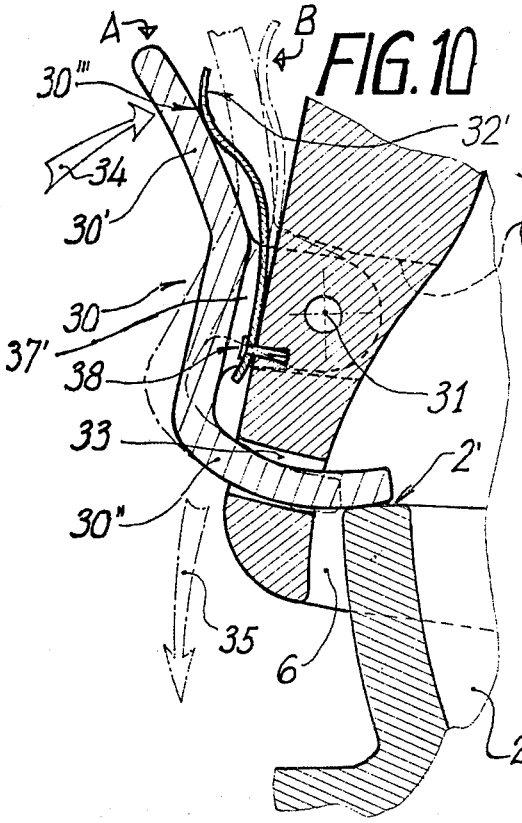
FIG. 10 is a view in vertical and longitudinal section, on a larger scale, of the lower, rear part of the boot of FIG. 9, the support member being shown in active position offering rear support.
Figure 11:
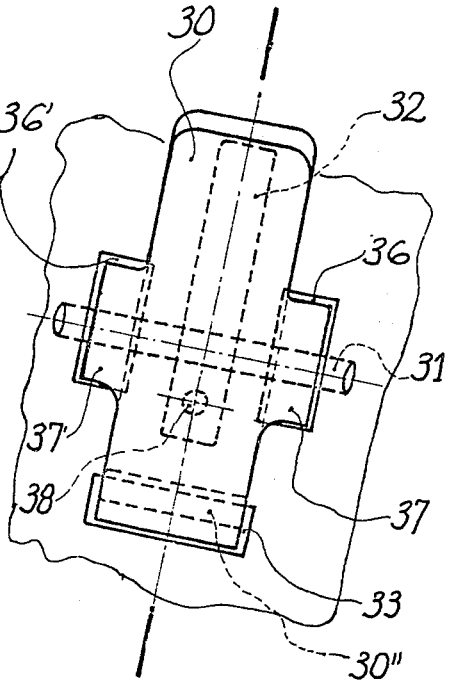
FIG. 11 is a partial view in elevation of the rear face of the "spoiler" in its lower part where the support member is implanted.

The ski boot shown in FIGS. 7 and 8 comprises a rear hooked lever 21 which extends, in closed position (FIG. 7), into a vertical notch 25 along the rear part of the spoiler 6. This rear hooked lever 21 carries a mechanism for tensioning a cable 24 which engages inside the boot and which acts on the foot via know tightening means.

The rear hooked lever 21 is provided, preferably in its lower zone (to ensure the effect of knuckle joint of this hook), with a projecting part 23, rectangular in cross section along a transverse plane i.e. perpendicular to the plane of the figure. This projecting part 23 extends forwardly of the boot and it is engaged in a housing 22 of corresponding shape, which housing is arranged in the lower, rear part of the spoiler 6.

In closed position of the boot (FIG. 7), the knuckle joint effect acts and ensures that the rear hooked lever 21 and its boss 23 are held against the spoiler 6, the boss 23 being engaged in the housing 22 of the spoiler. As may be seen in FIG. 7, in this closed position, the boss 23 which passes through the housing 22, projects forwardly with respect to the latter and the lower transverse face 23*a* of the boss 23 is in abutment on the upper edge 2' of the rigid shell bottom 2. Thus, during forward flexions of the skier's leg, the spoiler 6 may follow the forward movement of the leg, by pivoting about axis 7, in clockwise direction. In the course of this movement, the lower face 23*a* of the boss 23 moves upwardly away from the upper edge 2' of the shell bottom 2. This forward movement is limited by the flexibility of the upper 3 of the boot, as described with reference to the boot illustrated in FIG. 1.

On the other hand, during rearward support movements, the angular movement of the spoiler 6 in anti-clockwise direction is limited as the lower face 23*a* of the boss 23 forming wedge, abuts against the upper edge 2' of the shell bottom 2. This lower face 23*a* then performs the role of the lower arm 9' of the support member 9 in the embodiment illustrated in FIGS. 1 to 6.

To pass the boot into open position, (FIG. 8), the skier releases the rear hooked lever 21 and the lower boss 23 which it bears, from their respective housings 25 and 22. To this end, the skier exerts a downward action on the upper end 26 of the hook 21. The hook 21 and its lower boss 23 are thus separated from the spoiler 6, as illustrated in FIG. 8, whilst remaining connected to the cable 24. Thus, as the boss 23 no longer establishes the connection between the spoiler 6 and the upper edge 2' of the bottom of the shell 2, the spoiler may pivot freely rearwardly, this allowing the boot to be opened.

Moreover, it is understood that the embodiments of the invention which have been described hereinabove, with reference to the accompanying drawings, have been given purely by way of indicative and non limiting example and that numerous modifications may be made thereto without departing from the scope of the invention.

For example, whilst in the embodiment of the invention illustrated in FIGS. 1 to 6, the support member 9 is mounted to slide longitudinally in the slots 6', 6'' made in the lower part of the spoiler 6, it could also be mounted to pivot about a trasverse pin and comprise an arm, such as arm 9' engaged in a lower slot 6' of the spoiler 6, with locking means for immobilising the support member 9 in active position.

Furthermore, the support member 9 or 21, 23 could cooperate with another part of the bottom of the shell 2, and not with the upper edge 2' thereof, for example the lower edge of a vertical slot made in the bottom of the shell 2, the height of this slot being sufficient to allow the movements of forward flexion of the upper.

In the variant embodiment illustrated in FIGS. 9 to 12, the boot 1 comprises, in its lower, rear part, a support member 30 which is constituted by a substantially L-sectioned piece. This lever 30 forming support member is pivoted on the lower, rear part of the spoiler 6 about a transverse and horizontal pin 31. The lever 30 comprises a small lower arm 30'' which extends forwardly of the boot. This small arm 30'' is engaged through a slot 33 made in the lower, rear part of the spoiler 6 and it is substantially tangential to the upper edge 2'' of the bottom of the shell 2 in the so-called "active" position offering rear support. This small arm 30″ may have for example a certain curvature with upwardly turned concavity to allow simpler functioning.

The lever 30 also comprises a large arm 30′ which extends upwardly and which is substantially parallel to the rear face of the spoiler 6, on the lower part thereof. The large arm 30′ may be so curved that its upper end part 30‴ is bent slightly outwardly of the boot and upwardly, this thus promoting a better manipulation of the lever 30 forming support member.

The large arm 30′ comprises, approximately at mid-length, two side pieces 37–37′ extending longitudinally towards the front and forming a fork joint in which is engaged the transverse pin 31. The two side pieces 37, 37′ of the lever 30 are respectively engaged in two slots 36, 36′ formed in the lower part of the spoiler 6 so as to enable the fork joint 37–37′ to be housed inside this spoiler. The ski boot according to the invention further comprises elastic means which constantly urge the lever 30 forming support member towards its active position offering rear support. These elastic means may advantageously be constituted by a leaf spring 32 disposed between the large arm 30′ of the lever 30 and the rear face of the spoiler 6, this leaf spring 32 being fixed to its lower part by known means 38. The leaf spring 32 is fixed in a zone located beneath the articulation 31 of the lever 30, this pin 31 itself being located in front with respect to the large arm 30′.

Figure 12:
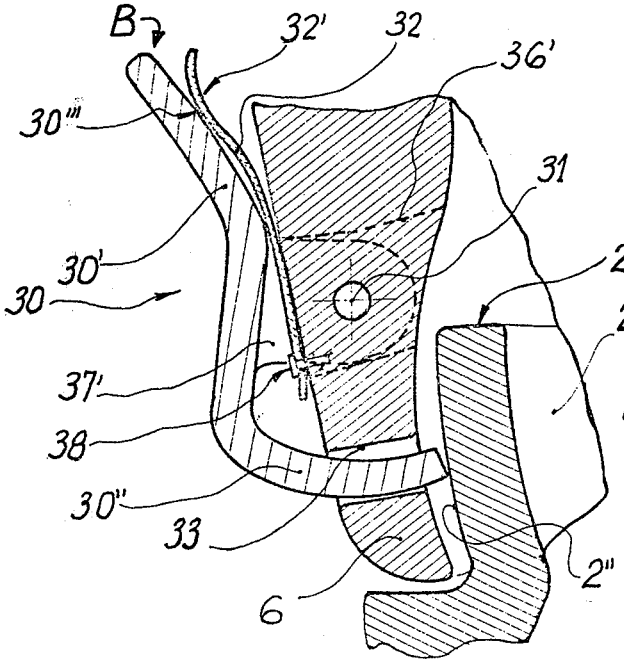
FIG. 12 is a view in partial section similar to that of FIG. 10, the rear support member being shown in inactive position when the spoiler is in rearwardly open position.

Furthermore, the free upper end part 32′ of the leaf spring 32 is preferably curved so as to present a rearwardly facing convexity and it abuts against the upper end part 30‴ of the large arm 30′ of the lever 30. Thus, the leaf spring 32 acts permanently on the lever 30 forming support member, pushing it rearwardly at its upper end part 30‴. Thus, when the skier exerts a pressure, indicated by arrow 34 in FIG. 10, on the upper end part 30‴ of the arm 30′, this pressure annuls the action of the return spring 32 and forces it to bend. Consequently, the whole lever 30 forming support member pivots about its axis 31 in the clockwise direction and passes from the active position offering rear support indicated by A in FIG. 10 to a release position indicated by B and shown in mixed lines in FIG. 10 and in solid lines in FIG. 12. In this release B, the front edge of the small arm 30″ of the lever 30 is shifted rearwardly beyond the end of the upper edge 2′ of the bottom part of the shell 2 so that it is possible for the skier to pivot all the spoiler 6 rearwardly as indicated by arrow 35 in FIG. 10, this releasing the skier's leg, for example with a view to removing the boot. FIG. 12 shows the support member 30 in inactive position obtained further to the preceding manoeuvre. In this position, said member is, however, still urged rearwardly by the action of the spring 32 which is stretched. The front edge of the small arm 30″ is therefore always applied under pressure, under the action of the spring 32, against the rear wall 2″ of the bottom of the shell.

To obtain the active position offering rear support, the skier having put on the boot according to the invention, folds the spoiler 6 on his/her leg bottom, pivoting it in clockwise direction about axis 7. In the course of this pivoting movement, the front edge of the small arm 30″ of the lever 30 slides upwardly along the rear wall 2″ of the bottom of the shell, until it reaches the level of the upper edge 2′. At this moment, no stop opposes the action of the spring 32 any more and consequently the latter, acting on the large arm 30′, causes the lever 30 to pivot in anti-clockwise direction. The spring 32 therefore allows the lever 30 forming support member to return automatically into its active position of rear support, in which its small arm 30″ is in abutment on the upper edge 2′ of the bottom of the shell 2, and this spring further ensures the locking, likewise automatic, of the spoiler 6 on the bottom of the leg.

It is obvious that various modifications may be made to the embodiment previously described without departing from the scope of the invention.

Thus, the spring 32 may advantageously be replaced by any other elastic means working in compression between the upper end part 30‴ of the lever 30 forming support member and the rear face of the spoiler 6. Other types of spring could also be used, working in traction or in torsion, to provoke the pivoting of the lever 30 in anti-clockwise direction.

Furthermore, the support zone of the lower small arm 30″ of the lever 30 forming support member may be other than the upper edge 2′ of the bottom part of the shell 2. More especially, particular arrangements may be provided on the bottom part of the shell, such as notches, teeth, multiple stops, made on the rear of the bottom part of the shell, to allow an adjustment of the rear support and of the locking of the spoiler.

What is claimed is:

1. In a ski boot of the type which is put on and taken off through the rear, comprising:

a shell continuously surrounding the zones of the foot and the front of the bottom of the leg and comprising respectively, a rigid bottom part of the shell around the foot and a more flexible upper of the shell around the front of the bottom of the leg;

a rear closing cover or spoiler pivoted on said shell, about a lower transverse axis, approximately in the malleolar zone, said spoiler surrounding the rear of said bottom of the leg and serving as cover for closing the boot on the foot, as well as means for rearwardly supporting the leg when in a position of use, connecting means connecting said rear closing spoiler and the monobloc upper-bottom of the shell assembly a member for supporting the upper formed by said spoiler and the flexible upper of the shell adapted to occupy a first active position for limiting the rearward angular movement of said upper, and a second inactive position allowing the upper freedom of angular movement, the improvement comprising: providing that the support member is formed of a piece having a U-cross section which extends transversely and provided with two arms, an upper arm and a lower arm, said arms being adapted to slide respectively in oblong and transverse slots provided in the lower, rear part of the spoiler and the support member removably mounted on the spoiler is, in active position of use, in direct contact with the rigid bottom of the shell.

2. A ski boot according to claim 1, wherein the support member is mounted to move rearwardly, and vice versa, in at least one slot formed in the lower part of the spoiler.

3. A ski boot according to claim 1, wherein the support member cooperates, by way of its lower face, with an upper edge of the rigid shell bottom.

4. A ski boot according to claim 1, wherein the support member cooperates by way of its lower face with the lower edge of a vertical slot of the rear part of the shell bottom.

5. A ski boot according to claim 1, wherein the support member is permanently connected to the spoiler and remains engaged therethrough in its inactive position.

6. A ski boot according to claim 1, wherein: the support member of U-cross section is mounted to slide on a pin passing through the spoiler, projecting outwardly and rearwardly and carrying, at its end, a stop and a device of the quarter turn type being provided to lock the support member in active position, said device comprising a locking lug mounted to rotate on the pin, between the web of the support member of U-cross section and the stop, said locking lug being formed to retract in a transverse oblong slot formed in the web of the support member.

7. A ski boot according to claim 1, wherein a spring fixed to the spoiler is provided to push the support member against the locking clip itself maintained in abutment on the stop.

8. In a ski boot of the type which is put on and taken off through the rear, comprising:

a shell continuously surrounding the zones of the foot and the front of the bottom of the leg and comprising respectively, a rigid bottom part of the shell around the foot and a more flexible upper of the shell around the front of the bottom of the leg, a rear closing cover or spoiler pivoted on said shell, about a lower transverse axis, approximately in the malleolar zone, said spoiler surrounding the rear of said bottom of the leg and serving as cover for closing the boot on the foot, as well as means for rearwardly supporting the leg when in a position of use, connecting means connecting said rear closing spoiler and the monobloc upper-bottom of the shell assembly, a member for supporting the upper formed by said spoiler and the flexible upper of the shell adapted to occupy a first active position for limiting the rearward angular movement of said upper, and a second inactive position allowing the upper freedom of angular movement, the improvement comprising: that the support member is separable from the spoiler, in an inactive position, and cooperates with a member controlling means for tightening the foot in the boot, and the support member is removably mounted on the spoiler, in an active position of use and in direct contact with the rigid bottom of the shell.

9. A ski boot according to claim 8 wherein the support member is constituted by a boss provided at the lower end of a hook adapted to be housed in a vertical groove provided in the rear face of the spoiler and connected by a cable to means for tightening the foot, said boss being engaged through a slot made in the spoiler and abutting, by its lower face, on an upper edge of the rear part of rigid shell bottom.

10. In a ski boot of the type which is put on and taken off through the rear, comprising:

a shell continuously surrounding the zones of the foot and the front of the bottom of the leg and comprising respectively, a rigid bottom part of the shell around the foot and a more flexible upper of the shell around the front of the bottom of the leg;

a rear closing cover or spoiler pivoted on said shell, about a lower transverse axis, approximately in the malleolar zone, said spoiler surrounding the rear of said bottom of the leg and serving as cover for closing the boot on the foot, as well as means for rearwardly supporting the leg when in a position of use, connecting means connecting said rear closing spoiler and the monobloc upper-bottom of the shell assembly, a member for supporting the upper formed by said spoiler and the flexible upper of the shell adapted to occupy a first active position for limiting the rearward angular movement of said upper, and a second inactive position allowing the upper freedom of angular movement, the improvement comprising: that the support member mounted to move on the spoiler is defined by a lever whose cross section is substantially in the form of an L, pivoting about a transverse axis, said lever having a large arm extending upwardly substantially parallel to the rear face of the spoiler and a small lower arm extending forwardly of the boot and abutting on the rear part of the shell bottom, when in active position offering rear support, and the support member is removably mounted on the spoiler, in an active position of use and in direct contact with the rigid bottom of the shell.

11. A ski boot according to claim 10 wherein there is proved means constantly urging the lever forming support member towards its active position offering rear support.

12. A ski boot according to claim 10, wherein the transverse pivoting pin of the lever is located substantially half-way along the large arm of the lever.

13. A ski boot according to claim 12, wherein the transverse pivoting pin is located outside the plane of the large arm of the lever, in front of this large arm.

14. A ski boot according to claim 10, wherein the small arm preferably having a curvature with upwardly facing concavity, is engaged through a slot formed in the lower, rear part of the spoiler.

15. A ski boot according to claim 10, wherein the large arm cooperates with two side members extending longitudinally and forwardly and forming a fork point for the transverse pivoting pin.

16. A ski boot according to claim 10, wherein: the small arm of the lever forming support member is applied against the upper, rear edge of the shell bottom to provide rear support.

17. A ski boot according to claim 10, wherein the large arm of the lever forming support member terminates in an upper end part which is curved outwardly and upwardly.

18. A ski boot according to claim 17, wherein there is provided an elastic member acting on the upper end part of the large arm of the lever.

19. A ski boot according to claim 18, wherein the elastic member is formed by a leaf spring firmly fixed on the rear face of the spoiler in a zone located beneath the pivoting pin of the lever forming support member, the free end part of the leaf spring being applied against the upper end part of the large arm of the lever.

* * * * *